US007520454B2

(12) United States Patent
Zelder et al.

(10) Patent No.: US 7,520,454 B2
(45) Date of Patent: Apr. 21, 2009

(54) CUTTING TOOL PERTAINING TO A CENTRIFUGAL PUMP

(75) Inventors: Manfred Zelder, Bonn (DE); Michael Müller, Essen (DE)

(73) Assignee: WILO AG, Dortmund (DE)

( * ) Notice: Subject to any disclaimer, the term of this patent is extended or adjusted under 35 U.S.C. 154(b) by 198 days.

(21) Appl. No.: 10/589,644

(22) PCT Filed: Jan. 11, 2005

(86) PCT No.: PCT/EP2005/000150

§ 371 (c)(1),
(2), (4) Date: Aug. 15, 2006

(87) PCT Pub. No.: WO2005/078286

PCT Pub. Date: Aug. 25, 2005

(65) Prior Publication Data

US 2007/0164136 A1 Jul. 19, 2007

(30) Foreign Application Priority Data

Feb. 16, 2004 (DE) ..... 10 2004 007 739

(51) Int. Cl.
*B02C 18/40* (2006.01)

(52) U.S. Cl. ..... 241/46.06; 241/185.6; 415/121.1

(58) Field of Classification Search ..... 241/185.6, 241/46.06; 415/121.1
See application file for complete search history.

(56) References Cited

U.S. PATENT DOCUMENTS 2,699,295 A * 1/1955 Page ..... 241/46.02
3,961,758 A * 6/1976 Morgan ..... 241/46.11

FOREIGN PATENT DOCUMENTS

DE 4438841 2/1996

* cited by examiner

*Primary Examiner*—Mark Rosenbaum
(74) *Attorney, Agent, or Firm*—Andrew Wilford

(57) ABSTRACT

The invention relates to a cutting tool pertaining to a centrifugal pump for liquids loaded with solids. Said cutting tool comprises a rotating cutting body comprising at least one opening forming a cutting edge and through which the liquid flows, the lateral surface of the cutting body facing the rotationally fixed opposite surface that also comprises at least one opening through which the liquid flows. The lateral surface of the cutting body, facing the opposite surface, is curved in a convex manner, and the opposite surface is curved in a correspondingly concave manner.

13 Claims, 6 Drawing Sheets

CUTTING TOOL PERTAINING TO A CENTRIFUGAL PUMP

CROSS REFERENCE TO RELATED APPLICATIONS

This application is the U.S. national phase of PCT application PCT/EP2005/000150, filed 11 Jan. 2005, published 25 Aug. 2005 as WO 2005/078286, and claiming the priority of German patent application 102004007739.8 itself filed 16 Feb. 2004, the entire disclosures of which are herewith incorporated by reference.

FIELD OF THE INVENTION

The invention relates to a cutter of a rotary pump for liquids containing solid materials, the cutter having a rotating blade having at least one opening through which the liquid flows and that forms a cutting edge, and wherein the blade has one end face directed toward a nonrotating counter surface that also has at least one opening through which the liquid passes.

BACKGROUND OF THE INVENTION

It is known to provide the impeller of a rotary pump with a cutter mounted on its inlet for comminuting solids contained in the transported liquid for the pump so the downstream pipes and devices are not plugged. In these rotary pumps, the impeller shaft normally is supported only adjacent the drive motor, so that the cutter vibrates on the shaft bearing that is near the pump impeller while cutting the solids to small pieces. In addition, during operation of rotary pumps, a radial force is applied on the impeller that thus applies an alternate bending to the impeller shaft. Due to this fact, friction occurs at least between the outer end faces of the rotating blade and the counter surface of the abutting, nonrotating element, as well as often in the outer edge, so that premature wear results. On the side that is diametrally opposite the friction point, the clearance is enlarged and thus, the danger of plugging due to solids that have not been cut is increased.

OBJECT OF THE INVENTION

The object of the invention is improving a cutter of a rotary pump such that low wear occurs while at the same time providing high cutting performance.

SUMMARY OF THE INVENTION

This object is attained according to the invention by the fact that the end face that is directed at the counter surface of the blade is convex and the counter surface is also concave.

Such a cutter has low wear since the surfaces can slide past each other without contact. This way, it is also assured that the cutter and the pump are not plugged and in particular long foreign bodies do not wrap around the blade and the impeller. When supported in a safe manner, it is easy to fabricate and assemble such cutter and a rotary pump.

BRIEF DESCRIPTION OF THE DRAWING

Two embodiments of the invention are represented in the drawings and will be described in detail in the following. In the drawings.

SPECIFIC DESCRIPTION

Figure 1:
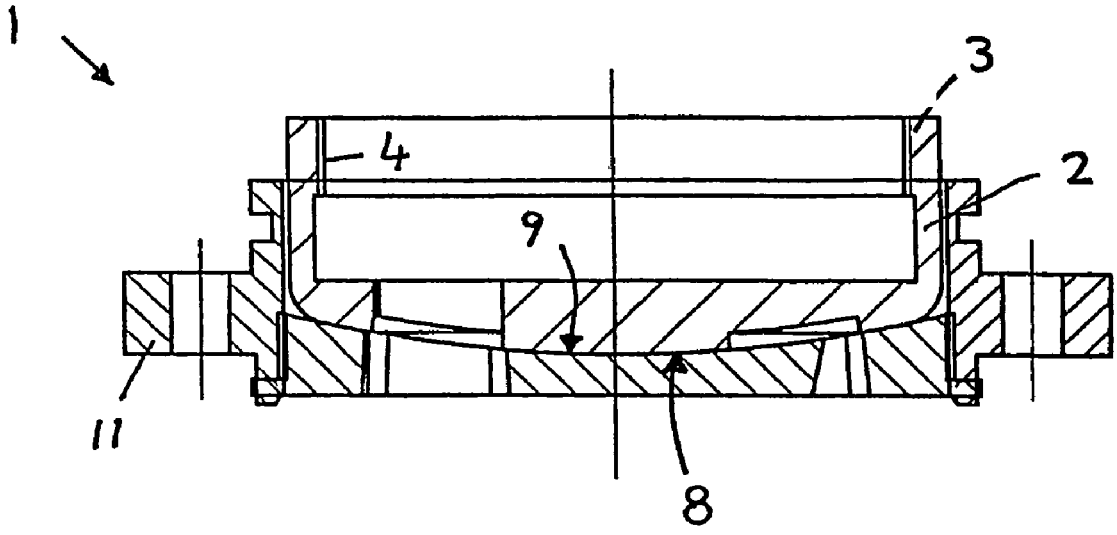
FIG. 1 is an axial section through a cutter of a first design.
Figure 2:
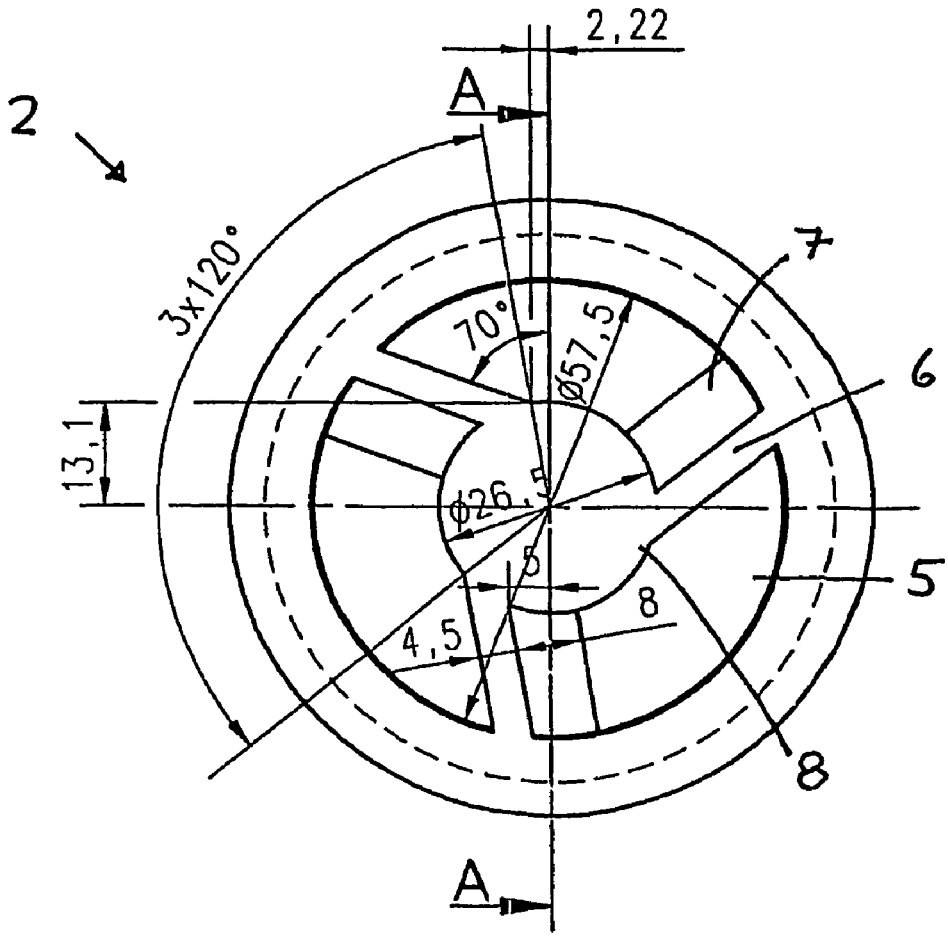
FIG. 2 is an end view of the rotating blade according to FIG. 1.
Figure 3:
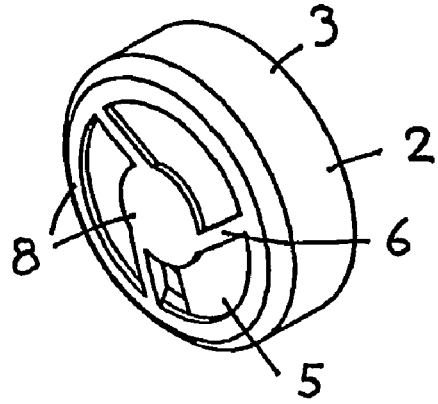
FIG. 3 is a perspective view of the rotating blade in reduced scale.

The cutter 1 of a rotary motor pump has a rotating blade 2 that is attached on the end of the pump impeller that is directed away from the electric drive motor. The blade 2 is designed cup-shaped and its upper rim surrounds the bush-shaped inlet opening of the impeller. Herein, the upper rim 3 preferably has an internal thread 4 or a press fit by means of which it can be screwed onto or pressed into the external thread or the cylindrical support of the impeller inlet opening.

The bottom of the blade 2 has three inlet openings 5 that are separated from each other by means of webs 6 on which radial cutting edges 7 are attached, in particular molded thereto. The cutting edges 7 thus form angles of 120° with each other.

The inlet openings 5 are shaped to extend at an angle to the rotational direction and thus, are set diagonal relative to the rotational axis, so that the blade 2 has the function of an "axial impeller."

The bottom end and thus the end of the blade 2 that is directed away from the impeller forms a convex end face 8 formed by a part of a spherical surface, so that the blade 2 in the area that is directed away from the impeller forms a spherical cap or dome. The edges of the cutting edges 7 are situated in the end face 8, so that these are curved. A radius R of the end face 8 has its end directed away from the end face 8 on the axis of the pump shaft at the same level as the pump shaft bearing that is adjacent the pump impeller.

Figure 4:
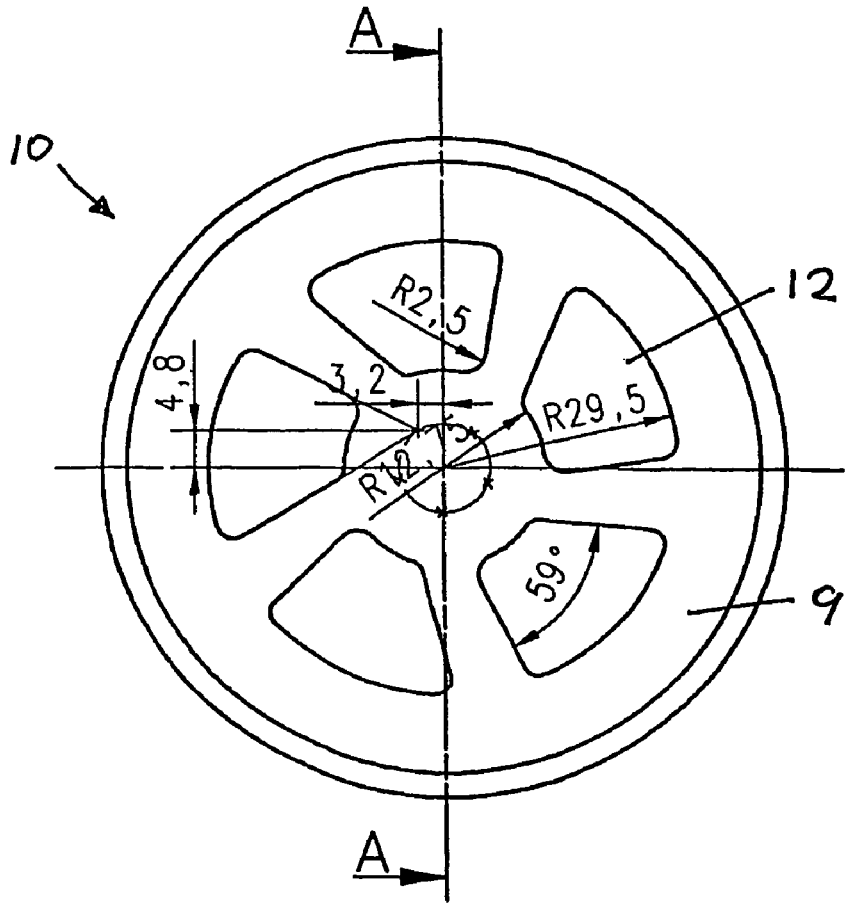
FIG. 4 is an end view of the nonrotating element.
Figure 5:
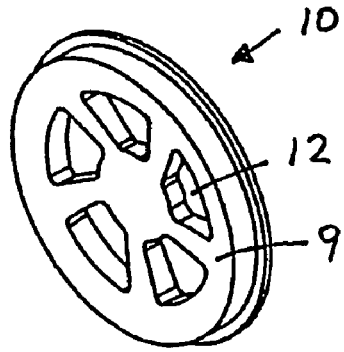
FIG. 5 is a perspective view of the nonrotating element in reduced scale.

The nonrotating element 10 shown in FIGS. 4 and 5 has two sector-shaped flow-through openings 12 that work together by means of their edges with the cutting edges 7. In the second embodiment, the cross-sections of the flow-through openings 12 are larger on the end that is directed away from the impeller than on the end facing toward the impeller. This way, a safe transport of swelling solids, in particular of hygiene articles, is assured.

A counter surface 9 of the nonrotating element 10 abuts the end face 8, the element 10 forming a concave recess that is complementary to the end face 8 and thus possesses the same radius R, if a normally small gap between the surfaces 8 and 9 is neglected.

Figure 6:
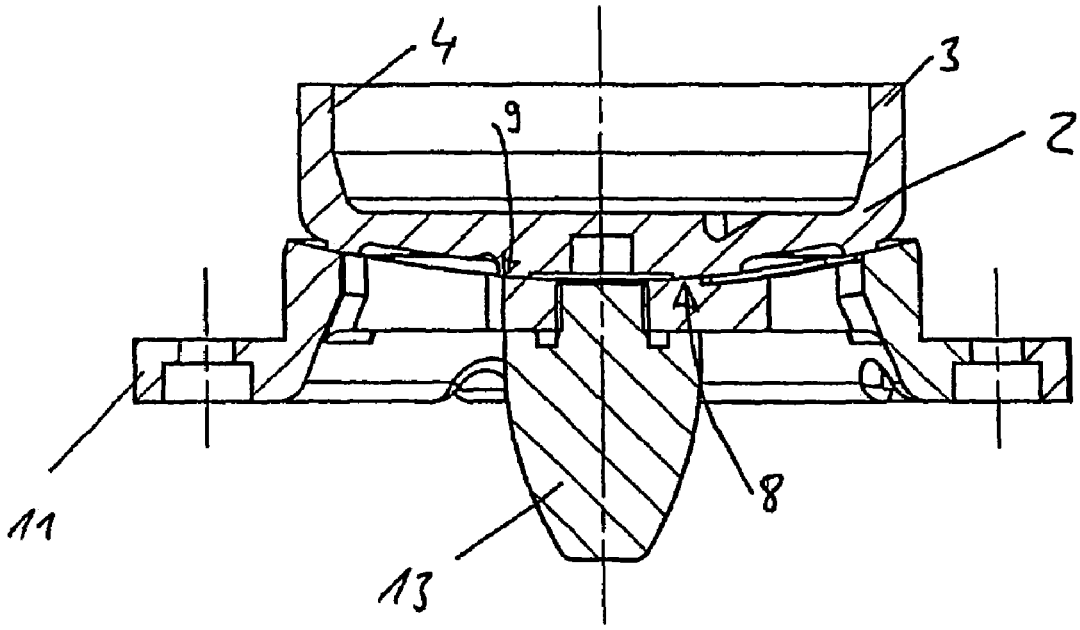
FIG. 6 is an axial section of the cutter of a second design.
Figure 7:
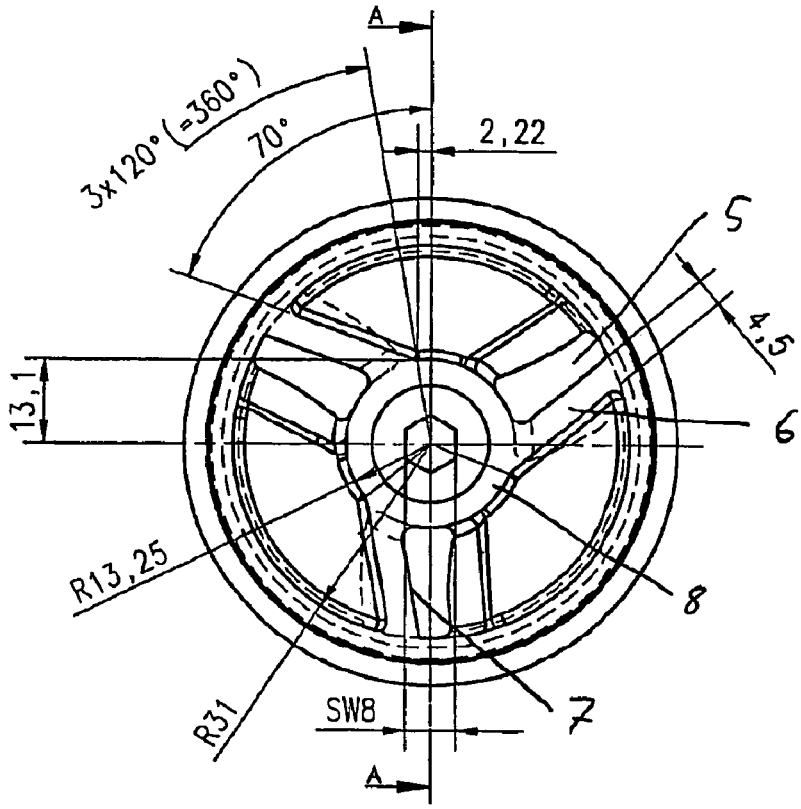
FIG. 7 is an end view of the rotating blade according to FIG. 6.
Figure 8:
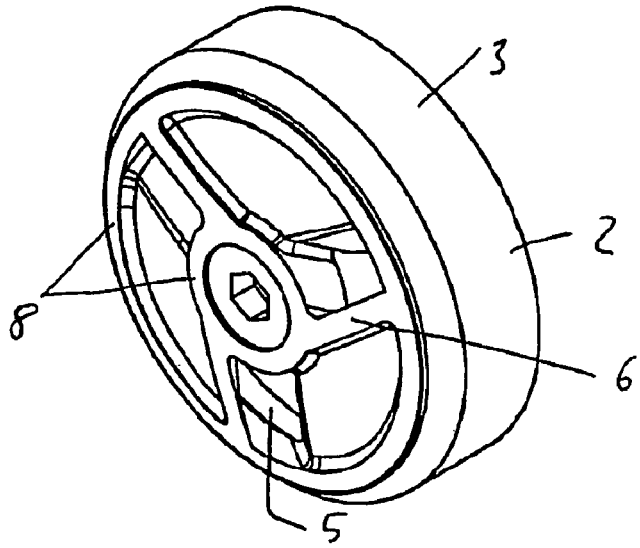
FIG. 8 is a perspective view of the rotating blade according to FIG. 7.
Figure 9:
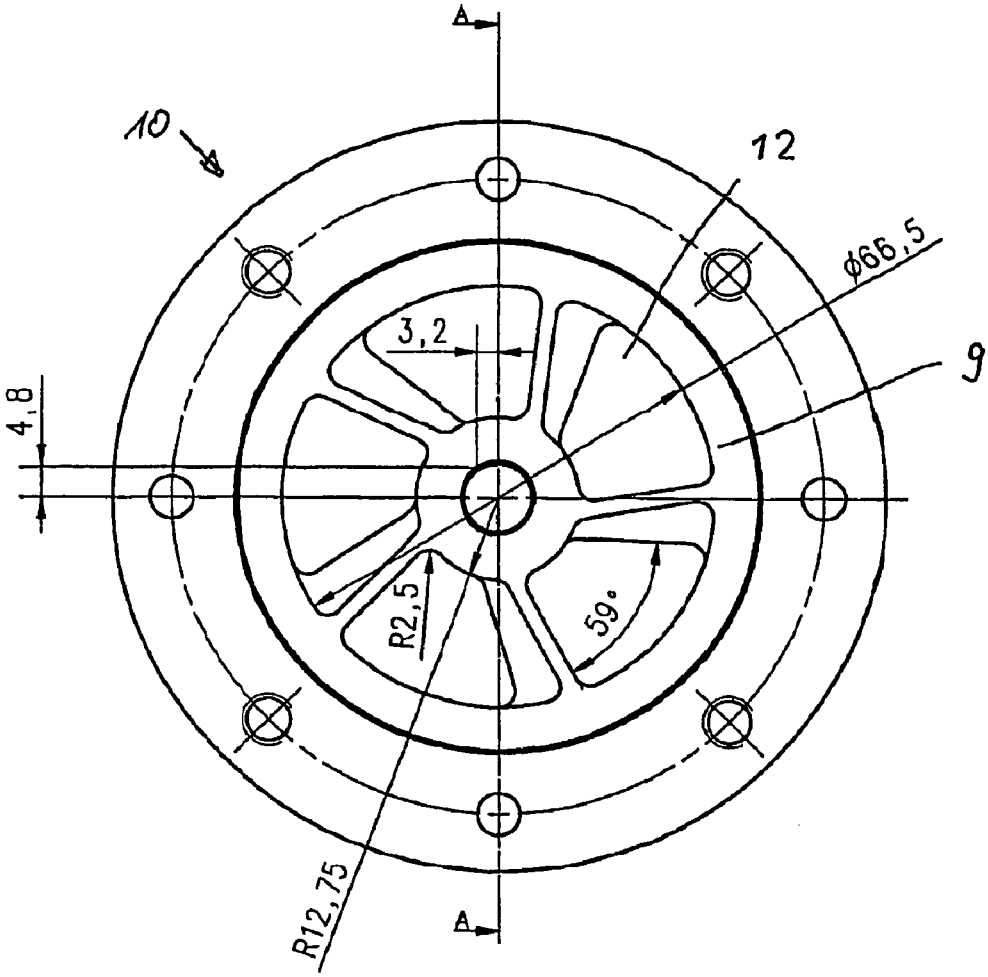
FIG. 9 is an end view of the nonrotating element of the second design.
Figure 10:
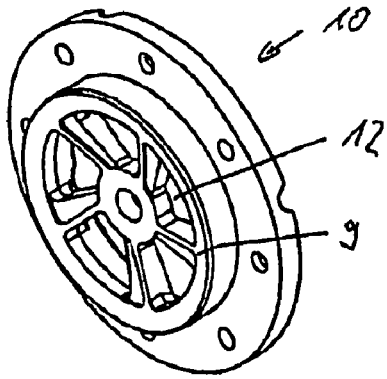
FIG. 10 is a perspective view of the nonrotating element of the second design in reduced scale.

In the second design, the nonrotating element 10 is provided in its center between the flow-through openings 12 with an inlet tip 13 that is similar to the rotor cap and that projects to the inlet end (FIGS. 6 and 7), so as to avoid plugging of the cutter upstream of the cutting plane. By means of the inlet tip, solids, in particular textiles, are conveyed to the flow-through openings instead of remaining in the center between the flow-through openings in front of the nonrotating element.

The element 10 that is circular on its outer edge is mounted in an annular flange 11 that is attached in the pump housing, in particular screwed onto it. Element 10 and flange 11 can also be designed as an integral piece.

The invention claimed is:

1. A cutter of a rotary pump for liquids containing solid materials, the cutter having a rotating blade having at least one blade opening through which the liquid flows and having a convex end face surrounding the at least one blade opening;

a cutting edge on the blade, bounding the at least one blade opening, and flush with the convex end face; and a nonrotating counter surface that has at least one flow-through opening through which the liquid flows, that aligns with the at least one blade opening on rotation of the blade, that is directed toward and closely juxtaposed with the convex end face of the blade, and that is complementarily concave to the end face of the blade.

2. The cutter according to claim 1 wherein the curvature of the end face of the blade is part-spherical.

3. The cutter according to claim 2 wherein the pump has an impeller, and an end of a radius of the curvature of the end face is situated on an axis of the pump shaft at the same level as a shaft bearing that is near the pump impeller.

4. The cutter according to claim 1 wherein the pump has an impeller, and the rotating blade is attached to the pump impeller at an end that is directed away from the counter surface.

5. The cutter according to claim 1 wherein the pump has a housing, and the counter surface is formed by a nonrotating element that can be fixed in or on the pump housing or that is formed by the pump housing.

6. The cutter according to claim 1 wherein the flow-through opening narrows in a flow direction and thus flares in a downstream direction.

7. The cutter according to claim 5 wherein the pump has a housing, and the nonrotating element is mounted in an annular flange that can be attached in or on the pump housing.

8. The cutter according to claim 1 wherein there are two to four sector-shaped blade openings.

9. The cutter according to claim 1 wherein there are four to six sector-shaped flow-through openings.

10. The cutter according to claim 1 wherein there are a plurality of the blade openings and of the flow-through openings, and the cutting edges are formed by radial webs between the blade openings.

11. The cutter according to claim 10, further comprising an inlet tip between the flow-through openings.

12. The cutter according to claim 1 wherein the rotating blade has the function of a further axial impeller due to the design of intake ports that extend at an angle relative to the rotational direction.

13. A cutter of a rotary pump for liquids containing solid materials, the cutter having a rotating blade having at least one blade opening through which the liquid flows and having a convex end face surrounding the at least one blade opening, the at least one blade opening flaring in a flow direction of the liquid through the at least one blade opening;

a cutting edge on the blade, bounding the at least one blade opening, and flush with the convex end face; and a nonrotating counter surface that has at least one flow-through opening through which the liquid flows, that aligns with the at least one blade opening on rotation of the blade, that is directed toward and closely juxtaposed with the convex end face of the blade, and that is complementarily concave to the end face of the blade.

* * * * *